United States Patent [19]

Vezirian

[11] 4,221,270

[45] Sep. 9, 1980

[54] DRAG BIT

[75] Inventor: Edward Vezirian, Fountain Valley, Calif.

[73] Assignee: Smith International, Inc., Newport Beach, Calif.

[21] Appl. No.: 970,669

[22] Filed: Dec. 18, 1978

[51] Int. Cl.[2] ..... E21B 9/36; E21B 13/01

[52] U.S. Cl. ..... 175/329; 175/410

[58] Field of Search ..... 175/329, 409, 410, 411, 175/412

[56] References Cited

U.S. PATENT DOCUMENTS

| | | | |
|---|---|---|---|
| 2,371,489 | 3/1945 | Williams, Jr. | 175/329 |
| 2,506,341 | 5/1950 | Bullock | 175/329 X |
| 3,599,736 | 8/1971 | Thompson | 175/329 |
| 3,640,356 | 2/1972 | Feenstra | 175/329 |
| 3,747,699 | 7/1973 | Feenstra et al. | 175/329 |
| 3,938,599 | 2/1976 | Horn | 175/329 |
| 4,073,354 | 2/1978 | Rowley et al. | 175/329 |
| 4,116,289 | 9/1978 | Feenstra | 175/329 |

*Primary Examiner*—James A. Leppink

*Attorney, Agent, or Firm*—Robert M. Vargo

[57] ABSTRACT

A rotary drag bit is disclosed which eliminates the problem of the disorientation and dislodging of cutting elements on the bit body. The drag bit includes a replaceable head cover which is adapted to be removably attached to the face and gage surfaces of the bit body head portion. The head cover is preferably made of tungsten carbide and includes a plurality of projections integrally formed thereon. These projections function as a backing and include a planar surface for receiving a plurality of synthetic diamond discs which are bonded thereto. The projections and discs are oriented radially on the bit body to face the direction of drag bit travel. The discs form cutting edges for gouging and removing cuttings from the bottom of the borehole. The tungsten carbide head cover functions as a wear surface around the bases of the cutting elements to prevent erosion thereof. By being integrally formed with the head cover, the projections are prevented from rotating or becoming dislodged. By being removable the head cover can be replaced when worn and the bit body can be used over again.

3 Claims, 5 Drawing Figures

FIG. 1
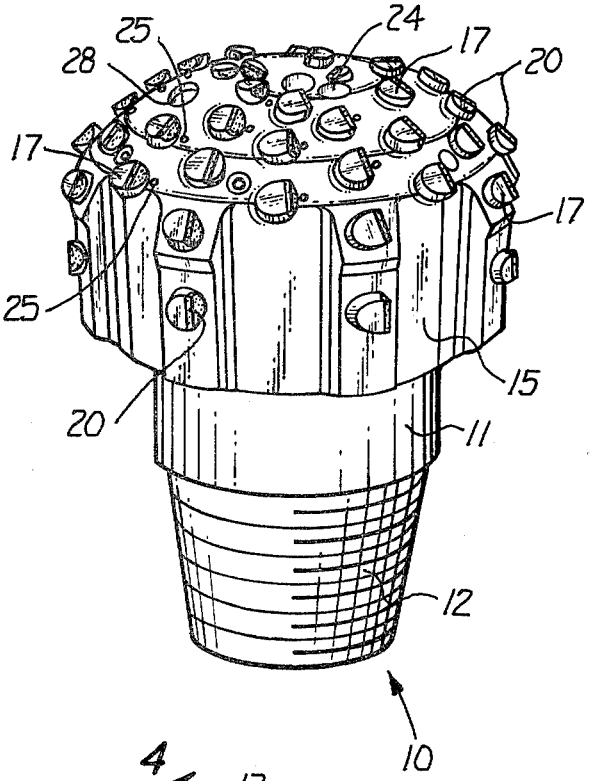
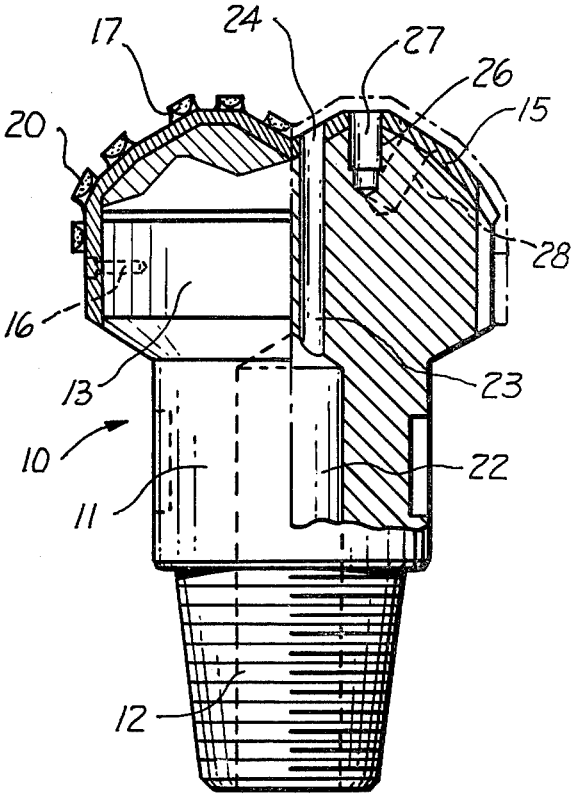
FIG. 2
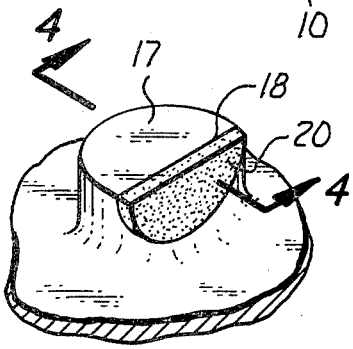
FIG. 3
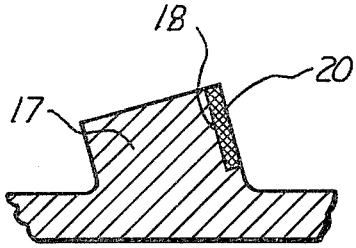
FIG. 4
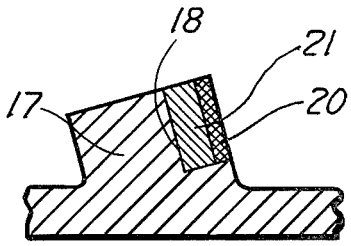
FIG. 5

DRAG BIT

BACKGROUND OF THE INVENTION

1. Field of the Invention

The present invention relates generally to drag bits and more particularly to drag bits utilizing cutters made of synthetic diamond material.

2. Description of the Prior Art

Conventional drag bits usually comprise a steel bit body having an upper end adapted to be attached to the bottom of a drill string. The lower end of the bit body comprises the cutting face which includes a plurality of cutting elements mounted thereon. The cutting elements may consist of a quantity of diamonds bonded to the face of the bit body.

Recently cutting elements utilizing synthetic diamonds have also been used. Each of these cutting elements comprises a slug preferably made of tungsten carbide which is substantially cylindrical in shape with the exception that one side thereof is planar in order to receive a disc of synthetic diamond material which is bonded thereto. The cylindrical base of the slug is adapted to be press fitted into bores formed in the face of the steel bit body. Each slug is positioned in its bore to have the face of the synthetic diamond disc oriented along the radius of the bit body facing the direction of rotation. The cutting edges of the synthetic diamond discs are then able to gouge away the earth formation at the bore hole bottom as the bit body is rotated on the bottom.

A major problem with such drag bits is that the slugs do not remain fixed within the bit body. During the cutting operations, these slugs often rotate within their bores which cause the cutting edges of the elements to face away from the direction of travel. When this occurs, the tungsten carbide slugs become worn and often become dislodged from the bores. This, of course, is deleterious to the cutting operation of the drag bit.

Another problem with conventional drag bits of the type described above is that, during operation, the face of the steel bit body becomes worn due to contact with the bore hole bottom and the cuttings located at the bottom of the bore hole. As a result, this wearing action causes the support around the base of the tungsten carbide slugs to erode which, in turn, causes the slugs to become dislodged.

SUMMARY OF THE INVENTION

The present invention obviates the above-mentioned problems by providing a drag bit that eliminates the disorientation and dislodging of cutting elements from the bit body.

In its broadest aspect, the present invention pertains to a drag bit having a solid bit body. The upper end of the bit body is adapted to be connected to a drill column while the lower end comprises a head portion. The head portion includes an outer face and gage surface which is adapted to receive a head cover made of tungsten carbide. The head cover includes a plurality of projections integrally formed thereon. Each projection includes a planar surface for receiving a disc made of a synthetic diamond material which is bonded thereto. The planar surfaces and discs are oriented radially to face the direction of drag bit travel.

An important advantage of the present invention is that by integrally forming the projections with the head cover, the projections are prevented from becoming dislodged or disoriented with respect to the bit body.

Another important advantage of the present invention is that the head cover also functions as a wear surface around the head portion or bit body 13 having a face surface 14 and a gage base of the projections.

Still another advantage of the present invention is that the head cover is replaceable, thereby enabling the bit body to be used again even after the cutting elements wear out.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

BRIEF DESCRIPTION OF THE DRAWINGS

FIG. 1 is a perspective view of a drag bit having a replaceable head cover with integrally formed projections in accordance with the present invention;

FIG. 2 is an elevational view, partially in section, of the drag bit of the present invention;

FIG. 3 is an enlarged fragmentary view of a cutting element;

FIG. 4 is a sectional view of the cutting element taken along lines 4—4 of FIG. 3; and FIG. 5 is a sectional view of a second embodiment of the cutting element.

DESCRIPTION OF THE PREFERRED EMBODIMENT

Referring now to the drawings, FIGS. 1 and 2 illustrate a rotary drag bit, generally indicated by arrow 10, comprising a steel body with a cylindrical end 11 having a threaded pin portion 12 which is adapted for connection to the lower end of a drill column. The steel body further includes an enlarged head portion or bit body 13 having a face surface 14 and a gage surface 19.

A replaceable head cover 15, preferably made of tungsten carbide, is adapted to extend over the face surface 14 and the gage surface 19 of the head portion 13. The head cover 15 is adapted to be removably attached to the head portion 13 by means of a plurality of bolts 16 (shown in dotted lines). It should be noted that other means for securing the head cover 15 to the head portion, 13 such as other conventional bonding methods, can be utilized. The head cover 15 further includes a plurality of projections 17 integrally formed thereon. Each of these tungsten carbide projections forms a backing or base for the cutting element and further includes a planar surface 18 for receiving a semi-circular disc 20 made of a synthetic diamond material which is bonded thereto. An example of a synthetic diamond material is manufactured and sold by the General Electric Company under the trademark "STRATAPAX". The planar surfaces 18 of the projections 17, along with the discs 20, are oriented substantially radially with respect to the drag bit 10 to face the direction of drag bit travel. As shown in FIGS. 4 and 5, the planar surfaces 18 and the discs 20 are oriented about 20° off normal from the base of the projections 17. Although the disc 20 is shown in a semi-circular form, other shapes and forms can be utilized.

FIGS. 3 and 4 show the disc 20 being bonded directly to the planar surface 18 of the projection 17. FIG. 5 illustrates a second embodiment in which a tungsten carbide substrate 21 is bonded to the disc 20 on the one side thereof and to the planar surface 18 on the other side.

The drag bit 10 further includes a central bore 22 extending axially through the interior thereof. The bore 22 is in communication with the interior of the drill string. A plurality of nozzle passages 23 (one of which is shown in FIG. 2) is provided to communicate with the central bore 22 and extend to the surface of the bit body 13 at nozzle 24. Registering bores are provided on the cover 15.

A plurality of individual nozzles 25 are also provided adjacent a number of the cutting elements. The passageways through the head portion 13 from the individual nozzles 25 which communicate with the central bore 22 are not shown.

A plurality of cylindrical bores 26 are also formed in the head portion 13 to enable dowel pins 27 formed on the head cover 15 to register therewith. A flat head socket 28, shown in dotted lines, is also formed in the head portion 13 and the head cover 15 to enable cap screws to be secured thereto. This provides a further means for attaching and securing the head cover 15 to the bit body 13.

In operation, after the head cover 15 is secured to the bit body 13, the drag bit 10 is attached to the bottom of a drill column and is inserted within a bore hole for drilling purposes. As the drill string and drag bit 10 are rotated at the bottom of the bore hole, the cutting elements formed by the projections 17 and discs 20 engage the bottom and gage of the bore hole to gouge and tear away the earth formation of the bore hole. Drilling fluid is pumped down the center of the drill string through the central bore 22, the passages 23 and the nozzles 24 and 25 to reach the bottom of the bore hole in order to remove the shavings and cuttings made by the cutting elements. This drilling fluid, along with the cuttings, then moves upwardly along the annulus formed by the bore hole and the outer surface of the drill string.

It should be noted that the tungsten carbide head cover 15 provides a hardened base for the cutting elements to prevent erosion at the base of these cutting elements. Moreover, by integrally forming the projections 17 with the head cover 15, these projections 17 are prevented from rotating or becoming dislodged during the drilling operation. Finally, when the cutting elements and the head cover 15 become worn through use, the head cover 15 can be replaced with a new one.

It should be noted that various modifications can be made to the assembly while still remaining within the purview of the following claims. For example, the head cover 15 can be made of two or more pieces, one piece covering the face surface 14 of the bit body 13, and the other piece covering the gage surface 19 thereof. Moreover, although the head cover 15 has been described as preferably being made of tungsten carbide, other materials such as the other carbides and similar metals made from powder metallurgy technology or alloy cast steel, can also be utilized in making the head cover 15.

What is claimed is:

1. A rotary drag bit comprising:

a main bit body having one end adapted to be connected to the lower end of a drill column, the other end comprising a head portion; and a single piece replaceable head cover made of tungsten carbide extending over said head portion, means detachably securing said head cover to said head portion, said head cover having a plurality of projections integrally formed thereon, each projection formed of the same material as said head cover, each projection having a planar surface, a cutting element including a quantity of synthetic diamond material bonded to the planar surface of each said projection and each of said cutting elements being in the form of a semi-circular disc having a cutting edge.

2. The combination of claim 1 wherein the planar surface of each projection and each disc is substantially radially oriented.

3. The combination of claim 1 wherein the planar surface of each projection is located on the leading or forward edge of each projection with respect to the direction of travel of each projection.

* * * * *